United States Patent [19]

Myers, Jr.

[11] Patent Number: 4,592,614

[45] Date of Patent: Jun. 3, 1986

[54] GENDER CHANGE CONNECTOR

[75] Inventor: Earl C. Myers, Jr., Harrisburg, Pa.

[73] Assignee: AMP Incorporated, Harrisburg, Pa.

[21] Appl. No.: 636,951

[22] Filed: Aug. 2, 1984

Related U.S. Application Data

[63] Continuation of Ser. No. 415,285, Sep. 7, 1982, abandoned.

[51] Int. Cl.[4] ..... H01R 13/50

[52] U.S. Cl. ..... 339/154 A; 339/176 MF; 339/103 M; 339/108 R

[58] Field of Search ..... 339/154, 156, 159, 97 R, 339/98, 99 R, 17 F, 176 MF, 103

[56] References Cited

U.S. PATENT DOCUMENTS

| | | | |
|---|---|---|---|
| 3,705,378 | 12/1972 | Elkins | 339/156 R |
| 3,876,276 | 4/1975 | Ayer | 339/107 |
| 3,963,300 | 6/1976 | Patton et al. | 339/156 R |
| 4,032,211 | 6/1977 | Tucci | 339/99 R |
| 4,083,615 | 4/1978 | Volinskie | 339/17 F |
| 4,143,935 | 3/1979 | Goodman et al. | 339/99 R |
| 4,147,399 | 4/1979 | Moser et al. | 339/99 R |
| 4,215,326 | 7/1980 | Hollyday | 333/182 |
| 4,236,779 | 12/1980 | Tang | 339/143 R |
| 4,257,028 | 3/1981 | Narozny et al. | 339/99 R |
| 4,290,664 | 9/1981 | Davis et al. | 339/156 R |
| 4,354,719 | 10/1982 | Weidler | 339/59 M |
| 4,392,701 | 7/1983 | Weidler | 339/17 R |

*Primary Examiner*—Gil Weidenfeld
*Assistant Examiner*—David L. Pirlot
*Attorney, Agent, or Firm*—Russell J. Egan

[57] ABSTRACT

An assembly (10) for effecting interconnection of like gender connectors (78, 80) on the ends of existing cables (82, 84) or between a cable and an equipment panel is formed by a pair of connectors (12, 14) of the same gender terminating opposite ends of a short length of multi conductor cable (16). The connectors (12, 14) are fixed in a back-to-back condition with the cable (16) and the gap between the connector enclosed in cover members (70, 72). The thus formed assembly can be used to mate cables and equipment having connectors of like gender which must be mated.

4 Claims, 4 Drawing Figures

GENDER CHANGE CONNECTOR

This is a continuation of application Ser. No. 415,285, filed 9/7/82, now abandoned.

The present invention relates to a connector which permits mating of like gender connectors, such as two male connectors terminating cable assemblies, or two female connectors one of which terminates a cable assembly and the other is panel mounted.

There are many instances when cabling of main and peripherial equipment creates a situation where connectors of like gender are already provided and must be mated. This could be accomplished by reworking the mating end of one cable to install a connector of the opposite gender. However, this is not always convenient to do since the interconnection of the main equipment with the peripherial equipment is generally accomplished somewhere in the field where there is not always access to equipment for changing connectors on the end of a cable. Not only are there problems associated with having extra connectors of the proper type and gender, as well as terminating tools, but loss of cable length caused by changing connectors could be a significant problem.

It is known in the telephone industry to have connectors which allow multiple terminations of a single cable at a single location. Examples of this may be found in U.S. Pat. Nos. 3,963,300 which shows a multiple tap and 4,032,211 which shows what is known as a half tap which allows two connectors to be mated to a single cable. However, both of these termination systems have the same type of connector at the free end of the cable. Further, examples may be found in U.S. Pat. Nos. 3,876,276 and 4,236,779 which are half tap configurations.

The present invention is a gender change connector formed by a pair of like connectors terminating opposite ends of a short length of flat cable, assembled in a back-to-back configuration, and enclosed by a housing. The connectors of the subject gender change connector are either plug or receptacle connectors and preferably employ an insulation piercing technique for terminating the cable. The cable can be either multi-conductor flat flexible cable or multi-conductor ribbon cable.

The present invention will be described by way of non-limiting example with reference to the accompanying drawings in which.

Figures 1, 2:
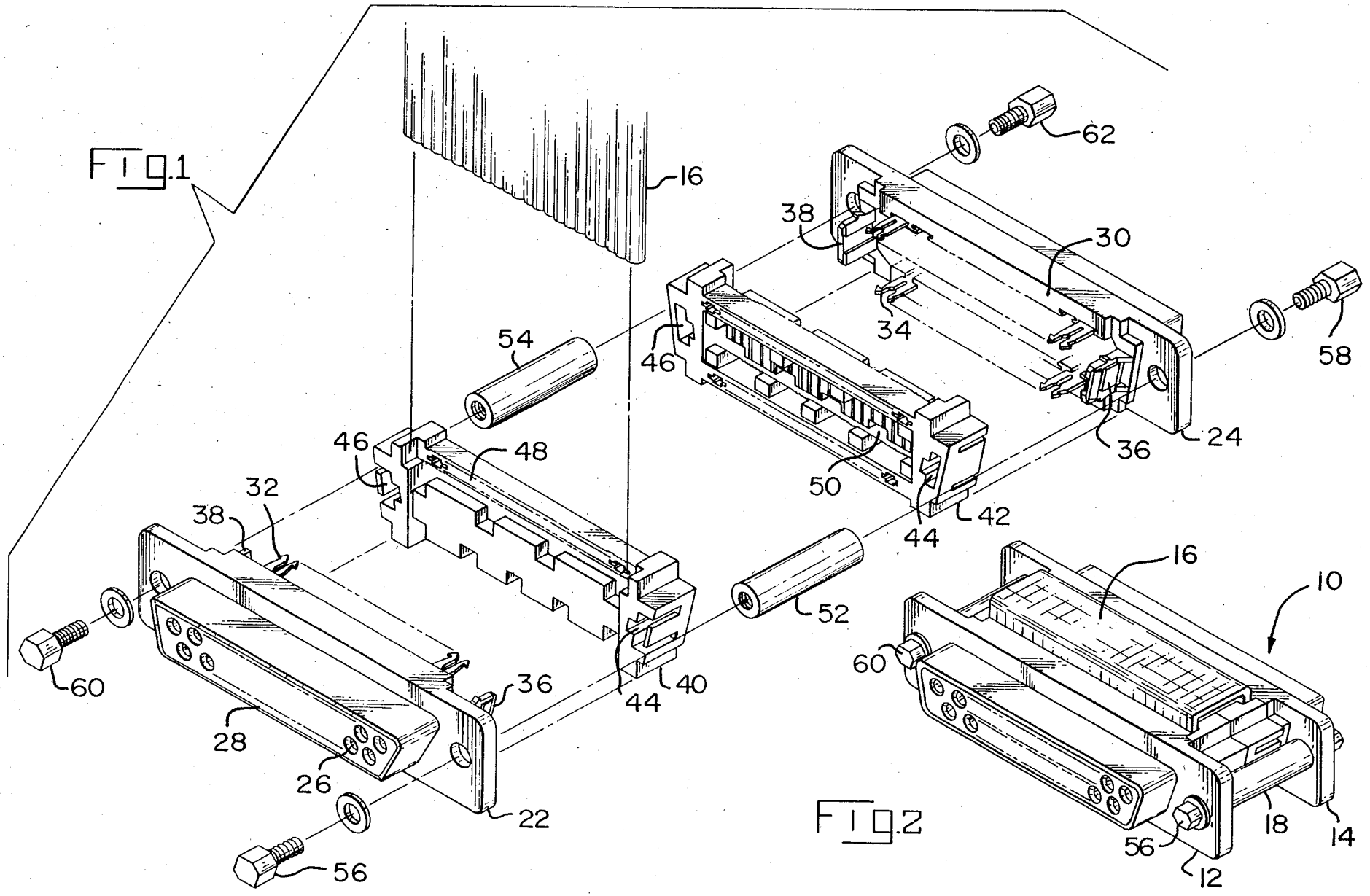
FIG. 1 is an exploded perspective view of a gender change connector according to the present invention.
FIG. 2 is a perspective view of the assembled connector according to the present invention.
Figure 4:
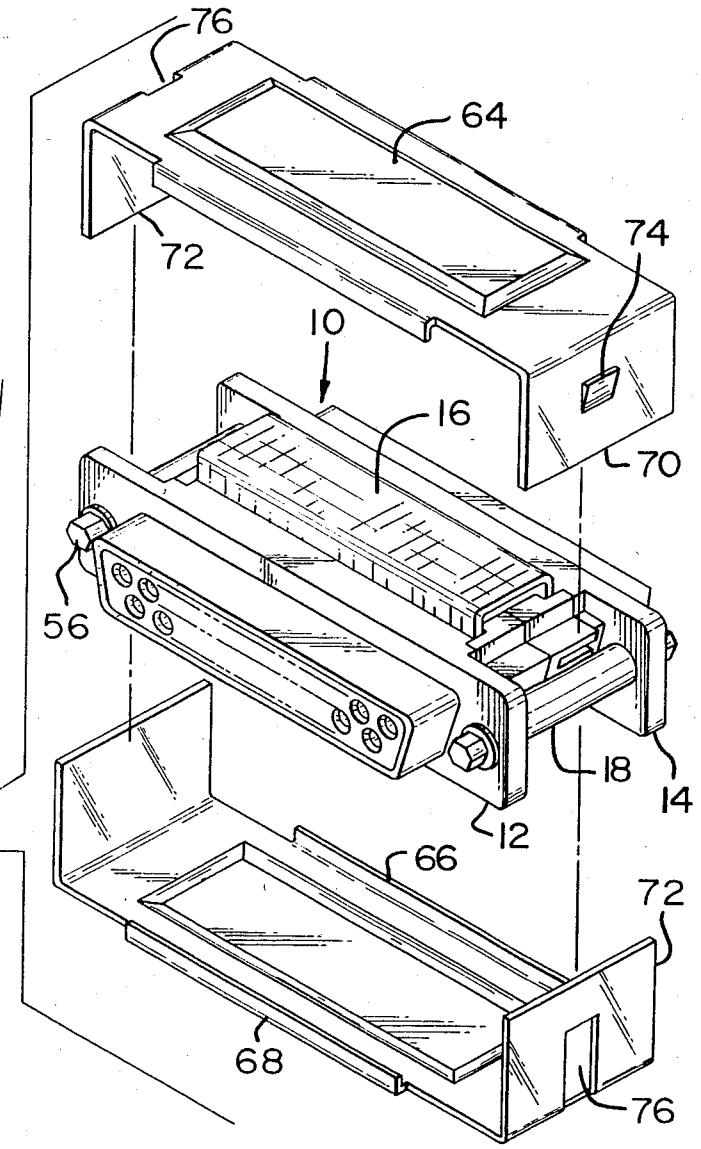
FIG. 4 is an exploded perspective view of the hermaphroditic covers to be used with the present invention.

The illustrated gender change connector has been shown utilizing a pair of receptacle connectors to intermate a pair of pin connectors. However, it is to be understood that the invention also encompasses the use of a pair of pin connectors in the same configuration to intermate a pair of receptacle connectors.

The subject gender change connector assembly 10 includes a pair of receptacle connectors 12, 14 terminating opposite ends of a short length of multi-conductor flat or ribbon cable 16 and secured substantially together in a back-to-back condition by hardware 18 and enclosed by hermaphroditic outer covers 20.

The connectors 12, 14 are like connectors each having an elongate housing 22, 24 of rigid insulative material with a plurality of terminal passages 26 extending between a mating face 28 and a rear surface 30, and a flange 29 having a hole 31 therethrough at each opposed end. A like plurality of terminals 32 are mounted in the respective passages 26 with each terminal 32 having a mating portion (not shown) directed toward or extending from the mating face 28 and an insulation displacing, conductor engaging portion 34 extending from the rear surface 30. Each housing 22, 24 is further provided with cover latching means 36, 38. Each connector 12, 14 further has a cable cover 40, 42 each with latching means 44, 46, a cable receiving slot 48, and a plurality of terminal receiving passages 50.

The hardware 18 includes spacing cylinders 52, 54 having a tapped hole 53 at each end to receive bolts 56, 58, 60, 62, respectively.

The outer covers 20 are hermaphroditic and each includes a profiled side cover portion 64 having depending longitudinal flanges 66, 68 and depending opposite end flanges 70, 72. Each end flange 70 includes an outwardly directed latching lug 74 while each end flange 72 includes a latching slot or recess 76 located to receive a respective lug 74 therein.

Figure 3:
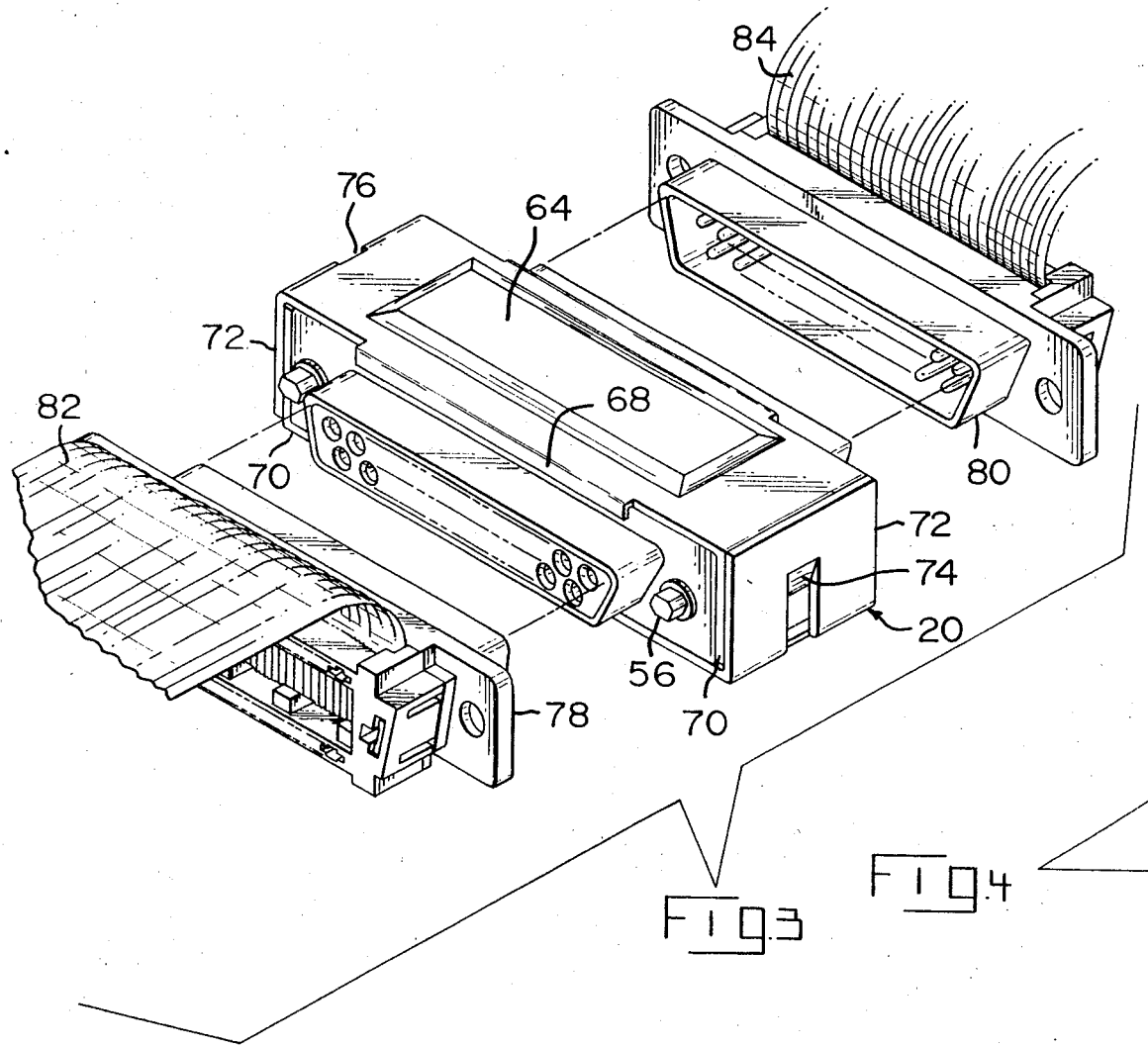
FIG. 3 is a perspective view of the subject invention as it would be used to interconnect a pair of cables having like connectors at the ends thereof.

The subject gender change connector is formed by terminating, in known fashion, a short length of cable 16 at opposite ends thereof with the respective connectors 12, 14. The connectors 12, 14 are then brought into a back-to-back position and secured by the hardware 18 through the conventional mounting flanges of the connectors. The thus formed assembly of cable 16 and connectors 12, 14 is then enclosed by the covers 20 with flanges 66, 68 gripping the respective elongated sides of the connectors 12, 14 and the cover portions 64 and end flanges 70, 72 covering the cable 16 and gap between connectors 12, 14. The assembly 10 is inserted into a system, such as shown in FIG. 3, with the connectors 78, 80 being either mounted on the ends of cables 82, 84, respectively, (as shown) which are to be joined or on the end of a cable and a panel of an equipment housing (not shown). To effect mating, the correct gender change assembly 10 according to the present invention is simply inserted between the two like existing connectors and the mating effected.

I claim:

1. An electrical connector assembly for electrically interconnecting connectors of like gender, said assembly comprising:

a pair of identical electrical connectors each of the type comprising an elongate housing having a mating face, an opposed rear surface, a mounting flange having opposed ends with a hole therethrough at each opposed end, and a plurality of terminals mounted therein, each terminal having an insulation displacing conductor engaging portion extending from said rear surface, each connector further comprising a cable cover latched against the rear surface of the housing, each said cover having a plurality of passages therein which receive respective conductor engaging portions of said terminals, a short length of multiconductor ribbon cable terminated at each end thereof to one of said pair of connectors, each conductor in said cable being terminated at opposite ends to respective terminals, said cable being retained therewith by said cable covers, hardware engaging said holes in said flanges to secure said pair of connectors substantially together in back-to-back relationship with said cable covers adjacent to each other and said mating faces opposed to each other, each hole being aligned with a respective hole of the other connector of the pair, said hardware comprising a pair of cylinders received between flanges at opposite ends of said back-to-back connectors, each cylinder having a tapped hole at each end thereof which is aligned with a respective hole in one of said flanges, said hardware further comprising bolt means received in said tapped holes through said flanges to secure said connectors in back-to-back condition.

2. A connector assembly as in claim 1 further comprising outer cover means enclosing portions of said pair of connectors between said flanges.

3. A connector assembly as in claim 2 wherein said outer cover means comprises a pair of identical outer cover members, each member having a pair of opposed end flanges, each end flange overlapping an end flange of the other cover member and being latched thereto.

4. A connector assembly as in claim 3 wherein each said cover member has a pair of opposed lateral flanges, each flange of each cover member overlapping a flange of the housing along an elongate side thereof.

* * * * *